US005439269A

United States Patent [19]

Cheng

[11] Patent Number: 5,439,269

[45] Date of Patent: Aug. 8, 1995

[54] CHAIR ASSEMBLY

[76] Inventor: W. H. Cheng, No. 323, Sec. 2, An Kang Rd., Hsin Tien City, Taipei Hsien, Taiwan

[21] Appl. No.: 231,507

[22] Filed: Apr. 22, 1994

[51] Int. Cl.[6] ..... A47C 4/02

[52] U.S. Cl. ..... 297/440.1; 108/150; 248/188.7; 297/440.22; 297/461

[58] Field of Search ..... 297/440.1, 440.22, 440.24, 297/461; 108/150, 157; 248/188, 188.7

[56] References Cited

U.S. PATENT DOCUMENTS 3,406,939 10/1968 Doernu ..... 248/188.7
3,734,301 5/1973 Rastoeny ..... 248/188.7 X
3,968,882 7/1976 Mello ..... 248/188.7 X
4,448,378 5/1984 Binfare ..... 248/188.7
5,288,045 2/1994 Edwards ..... 108/150 X

*Primary Examiner*—Peter R. Crown
*Attorney, Agent, or Firm*—Morton J. Rosenberg; David I. Klein

[57] ABSTRACT

A chair assembly, which includes a plurality of supporting legs connected to a locating member and a ring to hold a stem socket by plugging, a stem inserted into the center through hole on the stem socket and retained at the desired elevation by a tapered packing ring, a cushion, and a mounting device inserted into a bottom hole on the cushion and secured to the cushion through a rotary joint and having a bottom end fitted into a hole on the stem for permitting the cushion to be supported on the stem.

3 Claims, 10 Drawing Sheets

CHAIR ASSEMBLY

BACKGROUND OF THE INVENTION

The present invention relates to stands, and more particularly to a built-up chair assembly which can be conveniently set up or dismantled.

Various built-up chairs are known, and have been widely accepted for the advantage of easy to assemble and dismantle. Although these built-up chairs can be conveniently dismantled, the cushion and the seat stem are not detachable, therefore the cushion and seat stem unit is inconvenient to carry. Another drawback of these built-up chairs is that the parts may displace from one another causing the chairs unstable. Still another drawback of these built-up chairs is that the screws which are used to fasten parts together will wear out easily causing the chairs unable to function well.

SUMMARY OF THE INVENTION

The present invention provides a chair assembly which eliminates the aforesaid drawbacks. It is one object of the present invention to provide a chair assembly which is easy to assemble without the use of any tools. It is another object of the present invention to provide a chair assembly which can be conveniently dismantled. To achieve these objects, there is provided a chair assembly comprised of a plurality of supporting legs connected to a locating member and a ring to hold a stem socket by plugging, a stem inserted into the center through hole on the stem socket and retained at the desired elevation by a tapered packing ring, a cushion, and a mounting device inserted into a bottom hole on the cushion and secured to the cushion through a rotary joint and having a bottom end fitted into a hole on the stem for permitting the cushion to be supported on the stem.

DETAILED DESCRIPTION OF THE PREFERRED EMBODIMENT

Figure 1:
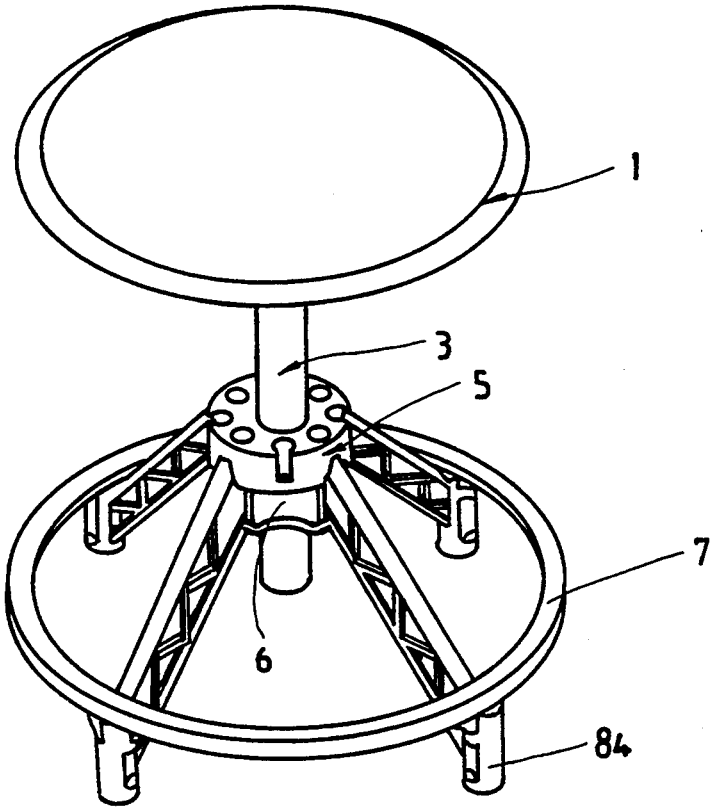
FIG. 1 is an elevational view of a chair assembly constructed according to the present invention.
Figure 2:
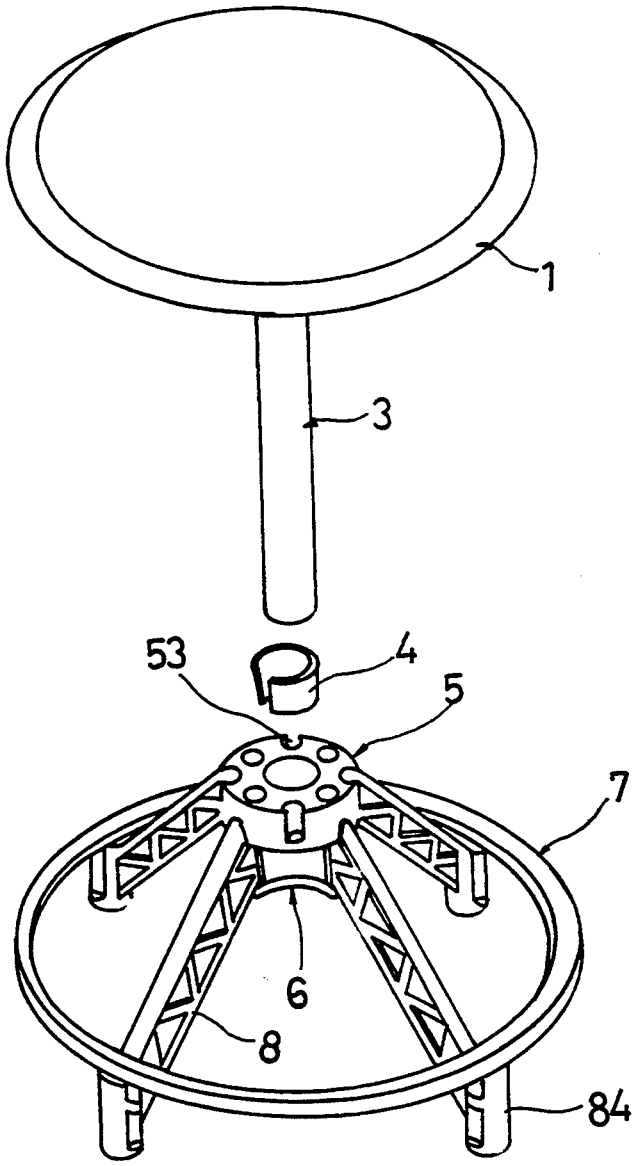
FIG. 2 shows the stem of the chair assembly shown in FIG. 1 removed from the stem socket thereof.
Figure 3:
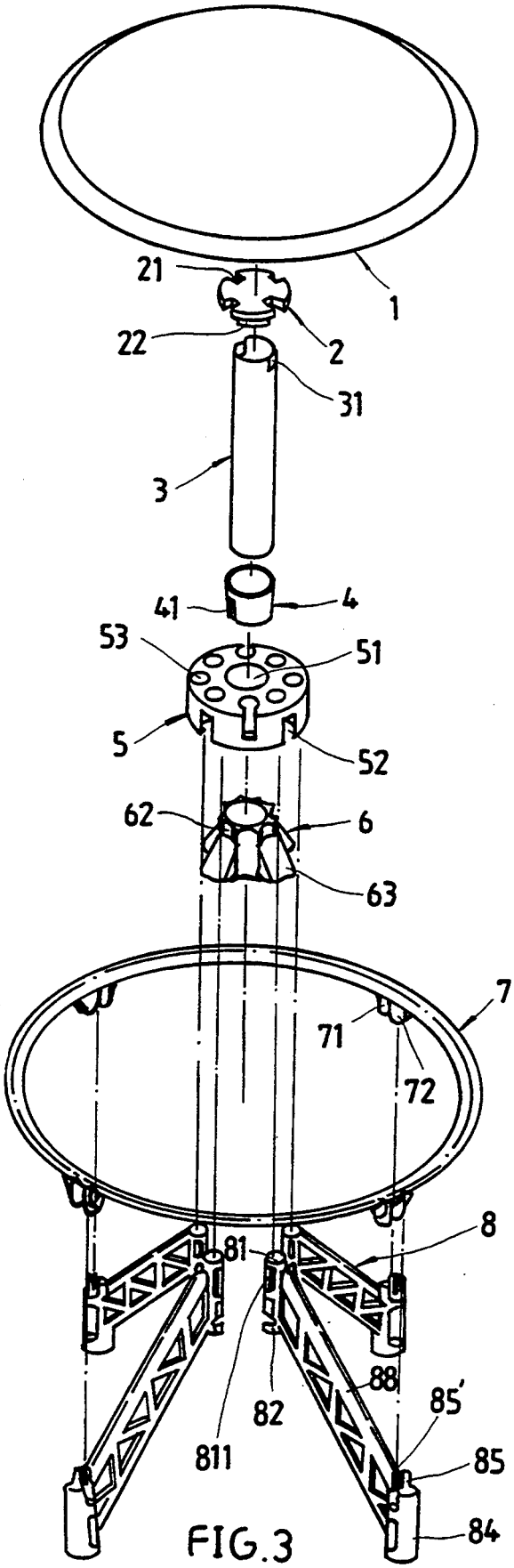
FIG. 3 is an exploded view of the chair assembly shown in FIG. 1.

Referring to FIGS. 1, 2, and 3, there is shown a chair assembly constructed in accordance with the present invention, generally comprised of a cushion 1, a mounting device 2, a tubular stem 3, a tapered packing ring 4, a stem socket 5, a locating member 6, a ring 7, and a plurality of supporting legs 8.

Figure 4:
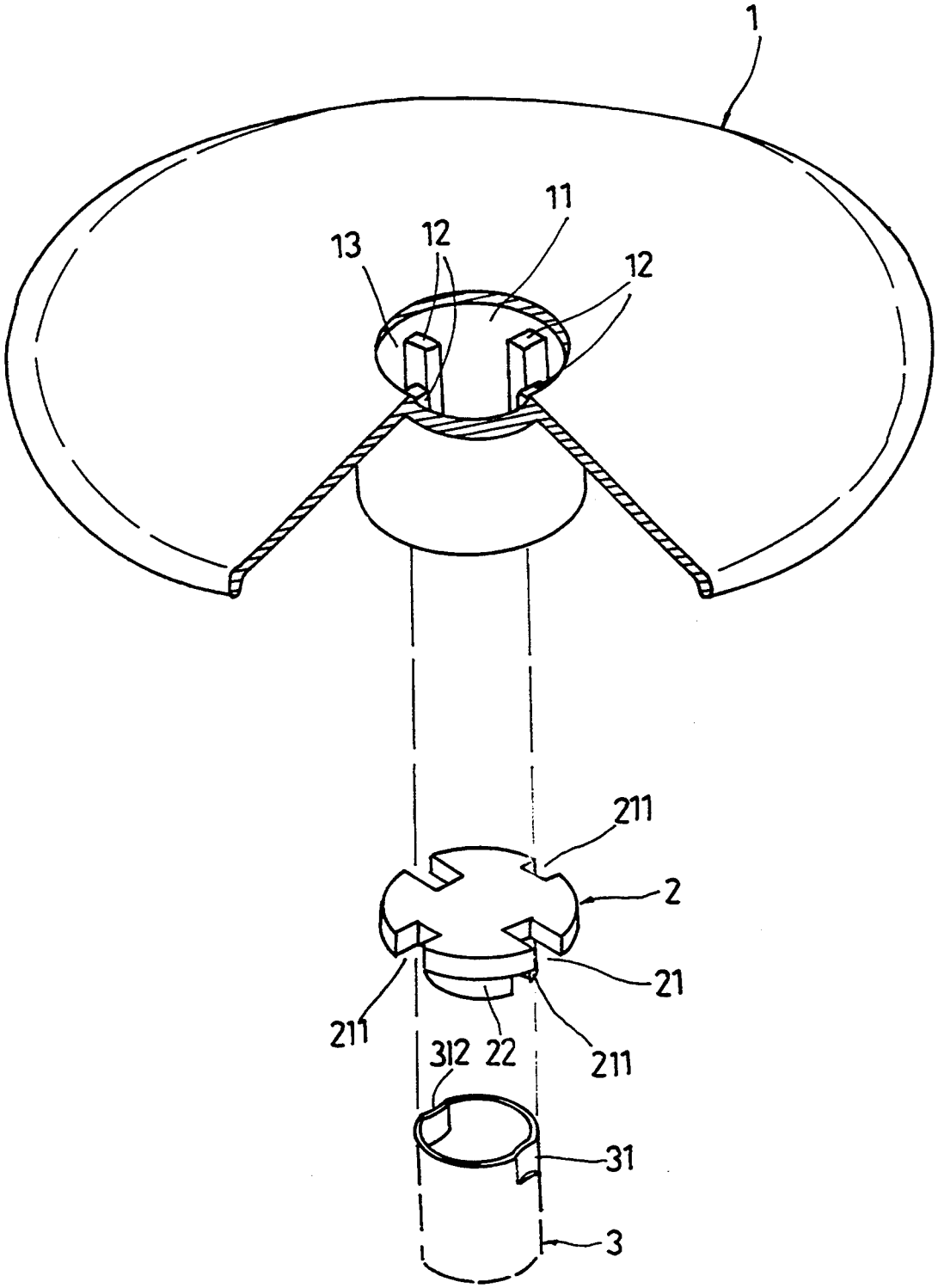
FIG. 4 shows the mounting structure of the cushion, mounting device and tubular stem of the chair assembly shown in FIG. 1.
Figure 5:
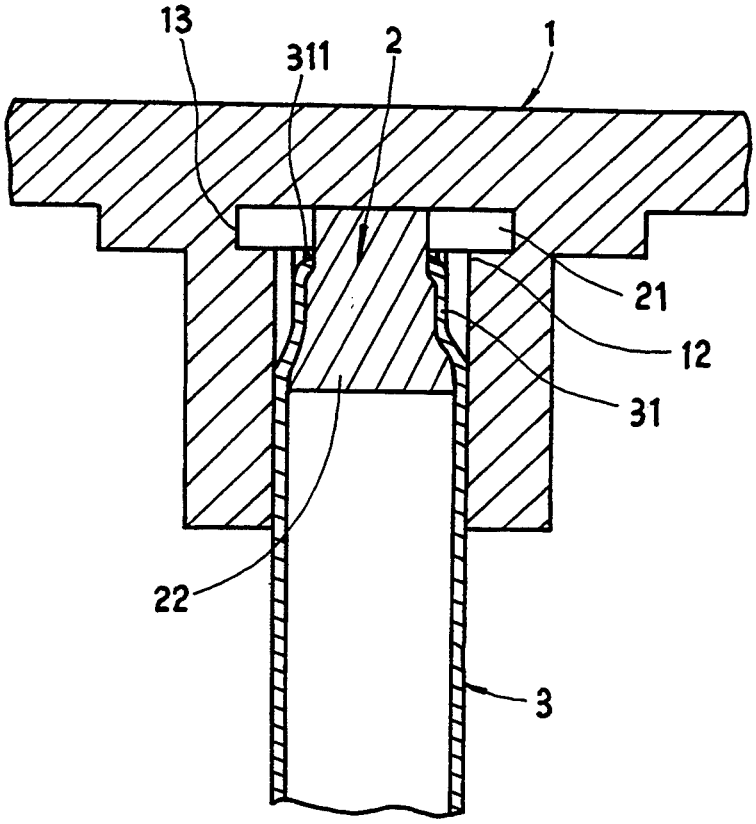
FIG. 5 is a sectional view showing the cushion, mounting device and tubular stem fastened together.
Figure 6:
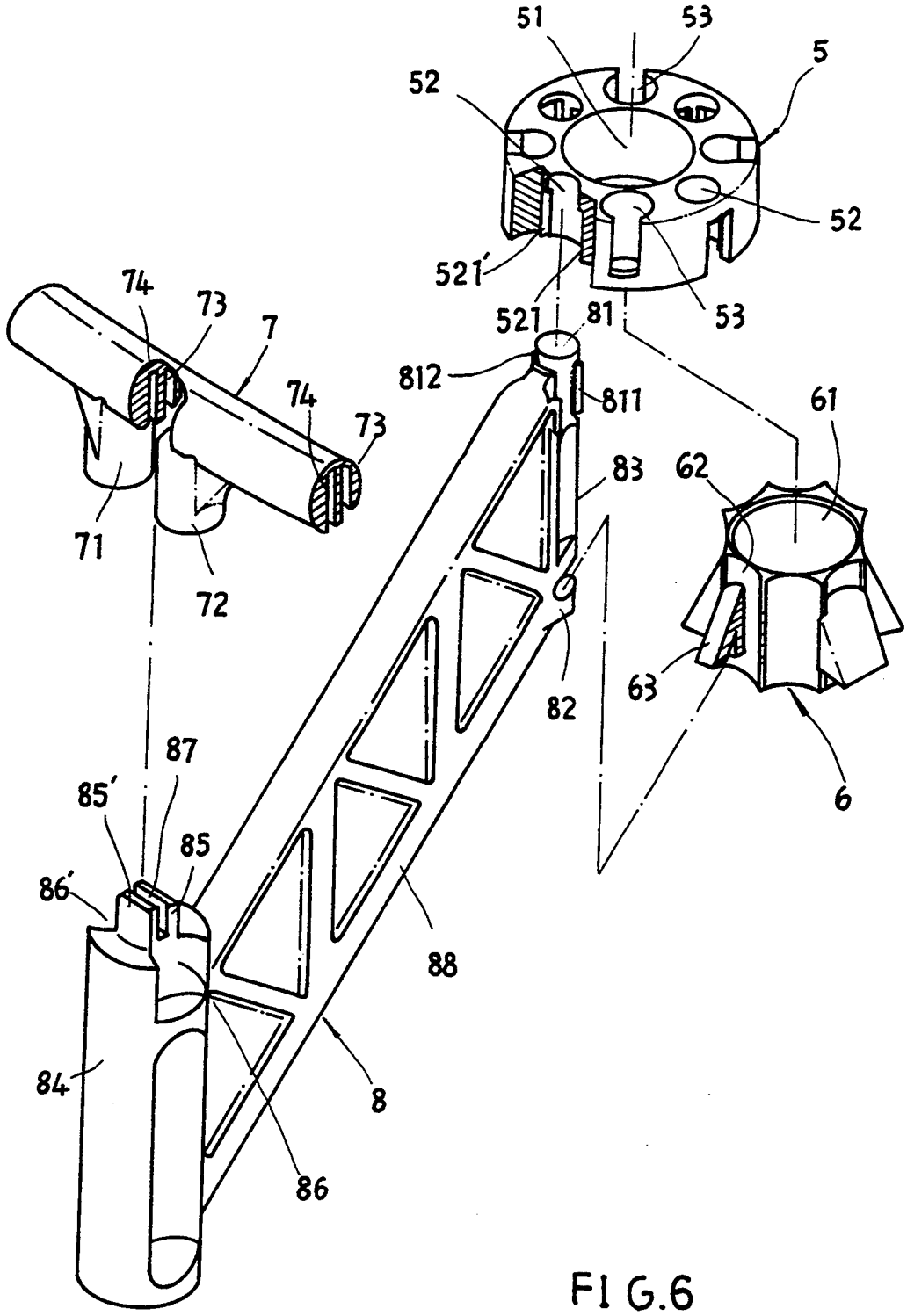
FIG. 6 shows the mounting structure of the stem socket, supporting leg, locating member and ring of the chair assembly shown in FIG. 1.
Figure 7:
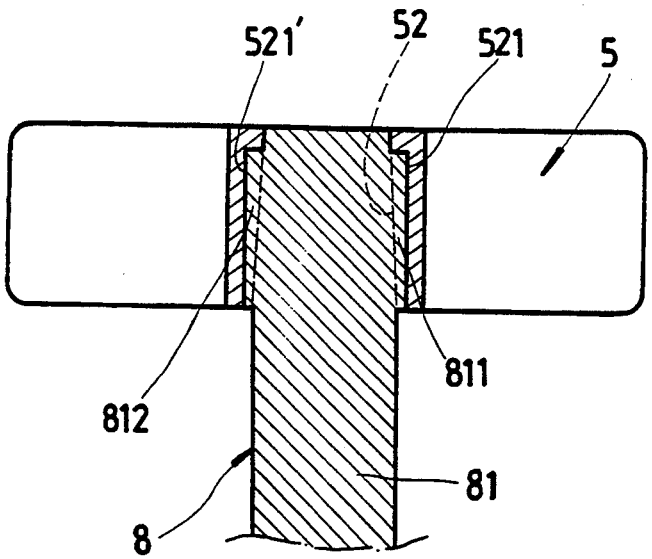
FIG. 7 is a sectional view showing the supporting leg fastened to the stem socket.
Figure 8:
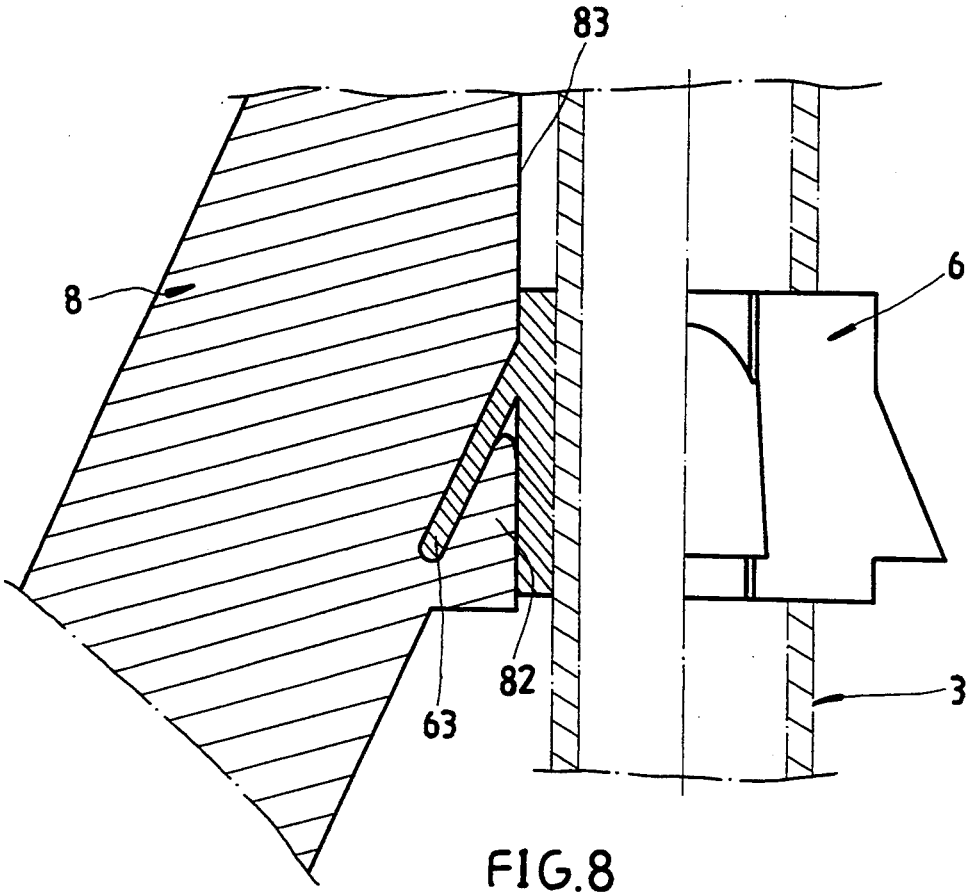
FIG. 8 is a sectional view showing the supporting leg fastened to the stem socket.
Figure 9:
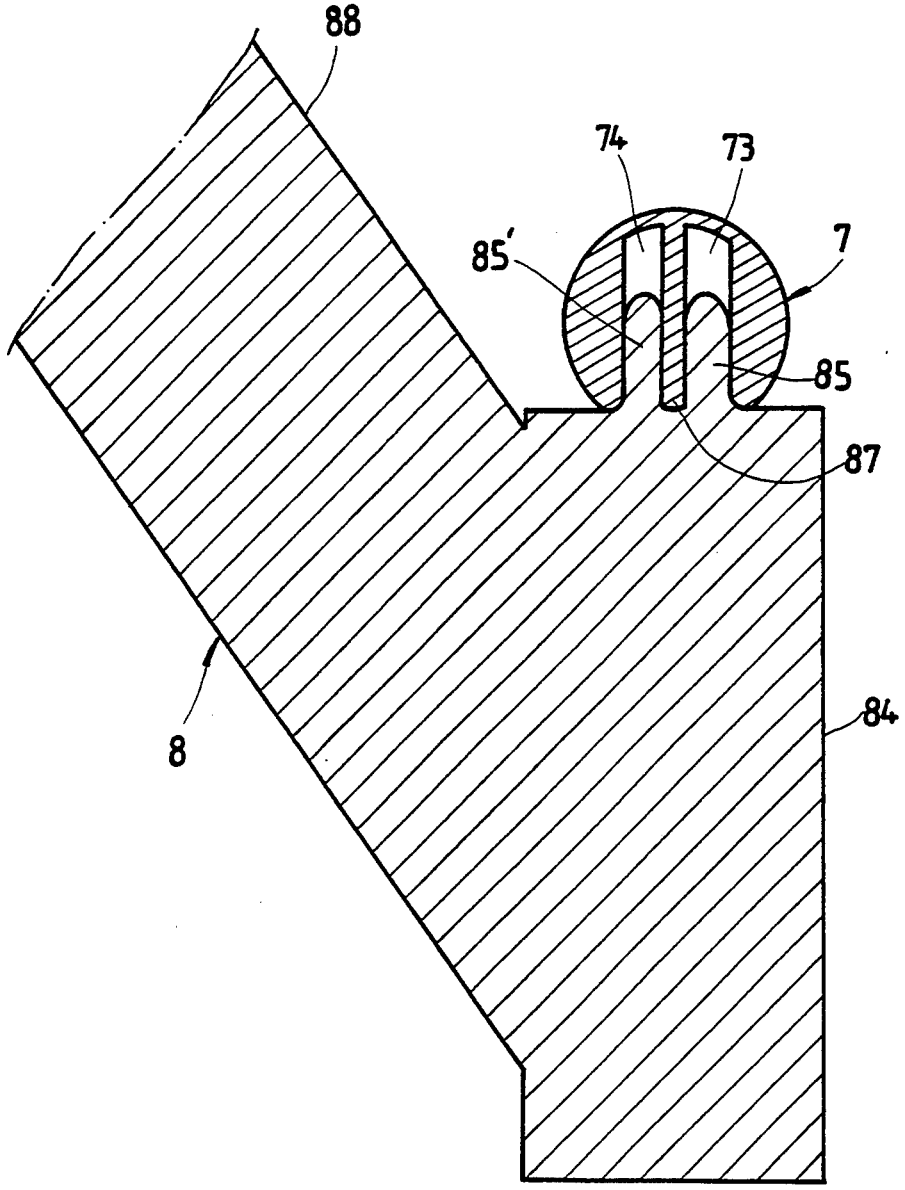
FIG. 9 is a sectional view showing the ring fastened to the supporting leg.

Referring to FIGS. 4, 5, and 6, the cushion 1 comprises a circular center hole 11 at the bottom, a plurality of vertical ribs 12 symmetrically spaced around the circular center hole 11, and an annular groove 13 around the vertical ribs 12 at the top. The mounting device 2 comprises a plurality of notches 21 symmetrically spaced around the periphery thereof, and a bottom rod 22 fitted into the tubular stem 3. When the bottom rod 22 of the mounting device 2 is inserted into the tubular stem 3, the tubular stem 3 is punched to form a plurality of recessed portions 31 around the top end thereof causing the bottom rod 22 of the mounting device 2 to be firmly secured to the tubular stem 3. When the recessed portions 31 are formed, the top edge 311 of each recessed portion 31 projects inwards and engages into the outside wall of the bottom rod 22 of the mounting device 2, and therefore the mounting device 2 and the tubular stem 3 are firmly retained together. Then, the mounting device 2 is inserted into the circular center hole 11 on the bottom of the cushion 1. By aligning the notches 21 on the mounting device 2 with the vertical ribs 12 around the circular center hole 11, the mounting device 2 can be inserted into the circular center hole 11. When the mounting device 2 reaches the annular groove 13, the tubular stem 3 is rotated through a certain angle relative to the cushion 1, to turn the mounting device 2 in the annular groove 13 for permitting the notches 21 not to be aligned with vertical ribs 12, and therefore the mounting device 2 becomes supported above the vertical ribs 12. Chamfered edges 211 may be made on mounting device 2 for guiding the vertical ribs 12 into the notches 21 quickly.

Referring to FIGS. 6, 7, 8, and 9, and FIGS. 1, 2, and 3 again, the stem socket 5 comprises a center through hole 51, which receives the tubular stem 3, a plurality of supporting leg mounting holes 52 and flower pot holder mounting holes 53 alternatively spaced around the center through hole 51. The stem socket 5 can be fastened to the tubular stem 3 at a desired elevation by the tapered packing ring 4. The tapered packing ring 4 is made from rubber or any suitable flexible material, having a split 41. When the tapered packing ring 4 is mounted around the tubular stem 3 and fitted into the center through hole 51 of the stem socket 5, the stem socket 5 is tightly secured to the tubular stem 3 at the desired elevation. There are vertical grooves 521;521' made on the inside wall of each supporting leg mounting hole 52 for mounting either supporting leg 8. Each supporting leg 8 comprises a first vertical bar 81 at one end for connection to the stem socket 5 and the locating member 6, a second vertical bar 84 at an opposite end for connection to the ring 7, and a connecting portion 88 connected between the first vertical bar 81 and the second vertical bar 84. The first vertical bar 81 comprises two raised blocks 811;812 bilaterally disposed at the top and respectively fitted into the vertical grooves 521;521' on either supporting leg mounting hole 52, a beveled retaining notch 82 near the bottom for connection to the locating member 6, and a contact surface portion 83 longitudinally disposed in the middle. The locating member 6 comprises a center through hole 61, which receives the tubular stem 3, a plurality of curved surface portions 62 spaced around the periphery thereof respectively attached to the contact surface portion 83 of the first vertical bar 81 of either supporting leg 8, a plurality of projecting tongues 63 respectively extended from the curved surface portions 62 and fitted into the beveled retaining notch 82 on the first vertical bar 81 of either supporting leg 8. The second vertical bar 84 of each supporting leg 8 comprises two recessed holes 86;86' bilaterally disposed on the top end thereof, two projecting strips 85;85' raised from the top end thereof and spaced by a gap 87. The ring 7 comprises two endless mounting grooves 73;74, which receive the projecting strips 85;85' of the second vertical bar 84 of each supporting leg 8, pairs of mounting rods 71;72 respectively fitted into the recessed holes 86;86' on the second vertical bar 84 of either supporting leg 8. When assembled, as shown in FIG. 1, the ring 7 serves as a foot rest.

The chair assembly can be conveniently dismantled by: removing the tubular stem 3 from the stem socket 5, then separating the ring 7 from the supporting legs 8, then separating the supporting legs 8 from the stem socket 5 and the locating member 6, and then turning the cushion 1 relative to the tubular stem 3 to let the ribs 12 be aligned with the notches 21 for permitting the cushion 1 to be separated from the mounting device 2 and the tubular stem 3.

Figure 10:
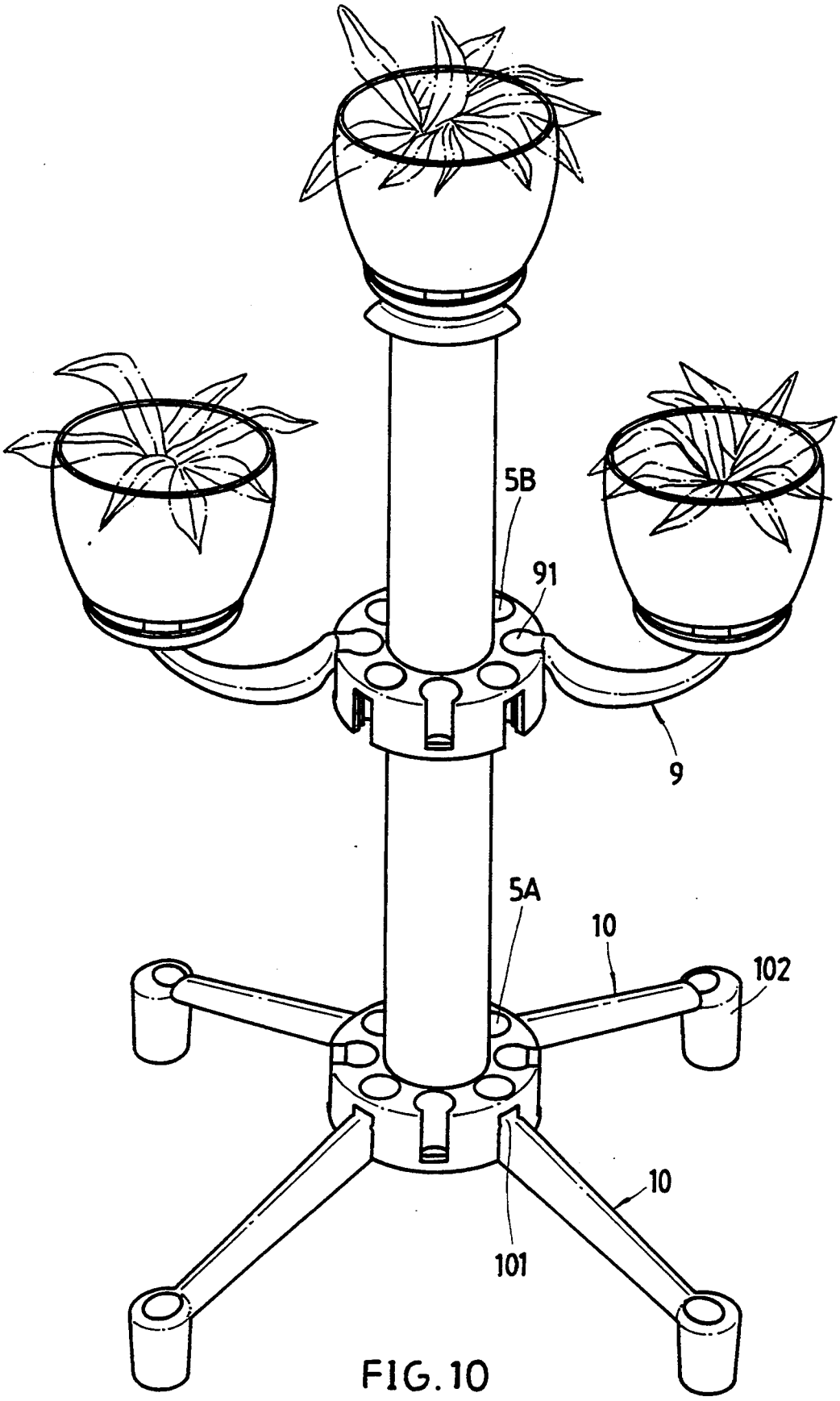
FIG. 10 shows an alternate form of the present invention to carry flower pot holders.
Figure 11:
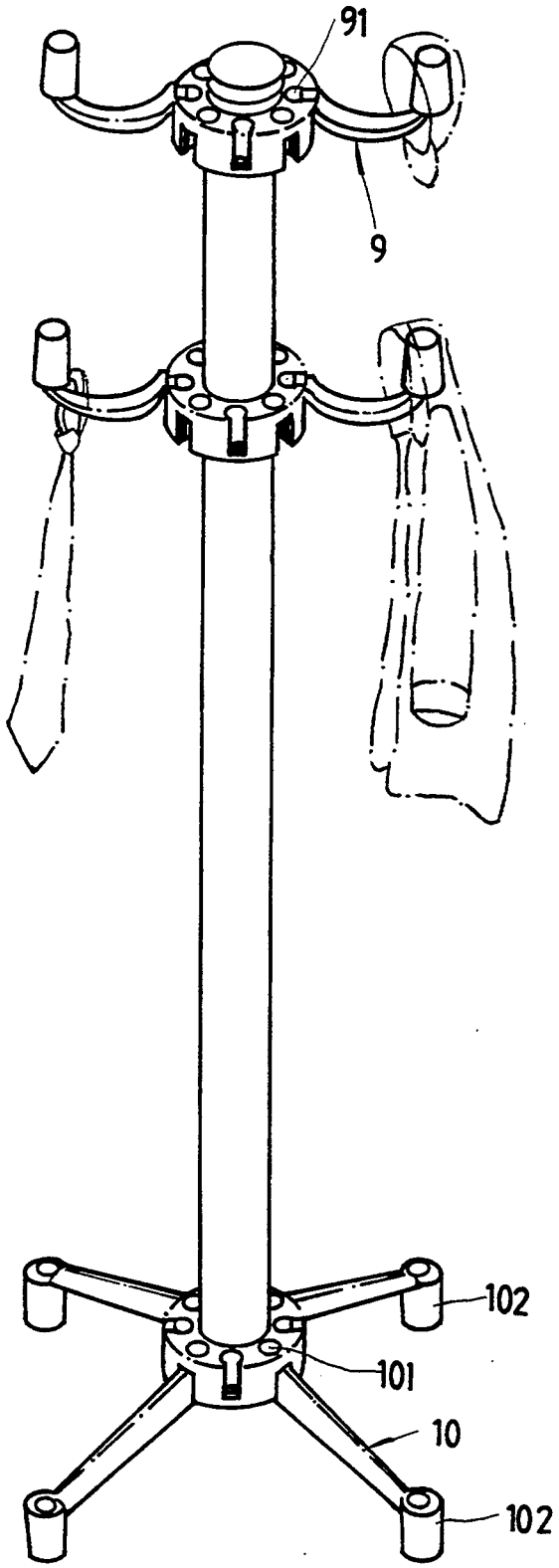
FIG. 11 shows another alternate form of the present invention for hanging clothes.

Referring to FIGS. 10 and 11, as an alternate form of the present invention, the supporting legs, referenced by 10, have each one end 102 supported on the ground and an opposite end 101 fastened to a bottom stem socket 5A; the flower pot holders (or cloth hangers in FIG. 11), referenced by 9, have a respective mounting rod 91 fastened to an upper stem socket 5B for carrying flower pots (or for hanging clothes.

What is claimed is:

1. A chair assembly, comprising:

a cushion having a circular center hole at the bottom, a plurality of vertical ribs symmetrically spaced around said circular center hole, and an annular groove around said circular center hole at the top;

a stem having a mounting device fastened to a top end thereof, said mounting device being inserted through said circular center hole into said annular groove and turned through an angle to become supported on said vertical ribs;

a stem socket mounted around said stem, said stem socket having a plurality of supporting leg mounting holes, each supporting leg mounting hole being made gradually smaller toward the top and having two vertical grooves on the periphery at two opposite locations;

a tapered packing ring fitted in between said stem and said stem socket to hold down said stem socket in position;

a plurality of supporting legs for supporting said stem socket on the ground, said supporting legs having each a first vertical bar at one end respectively connected to either supporting leg mounting hole on said stem socket and a second vertical bar at an opposite end disposed at a lower elevation than said first vertical bar, said first vertical bar having two raised blocks bilaterally disposed at the top and respectively fitted into the two vertical grooves inside either supporting leg mounting hole and a beveled retaining notch at the bottom, said second vertical bar having two recessed holes bilaterally disposed at the top, two projecting strips raised from a top wall thereof and spaced by a gap;

a locating member mounted around said stem to connect said supporting legs together, said locating member comprising a center through hole, which receives said stem, and a plurality of projecting tongues respectively fitted into the beveled retaining notch on the first vertical bar of either supporting leg; and a ring mounted on the second vertical bar of each supporting leg, said ring having two endless mounting grooves, which receive the projecting strips of the second vertical bar of each supporting leg, pairs of mounting rods respectively fitted into the recessed holes on the second vertical bar of each supporting leg.

2. The chair assembly of claim 1 wherein said stem socket further comprises a plurality of mounting holes for mounting flower pot holders.

3. The chair assembly of claim 1 wherein said stem socket further comprises a plurality of mounting holes for mounting clothes hangers.

* * * * *